US006457455B2

(12) United States Patent
Baeuerle et al.

(10) Patent No.: US 6,457,455 B2
(45) Date of Patent: Oct. 1, 2002

(54) METHOD FOR DETECTING COMBUSTION MISFIRES AND CYLINDER EQUALIZATION IN INTERNAL COMBUSTION ENGINES WITH KNOCK CONTROL

(75) Inventors: Michael Baeuerle, Markgroeningen; Klaus Ries-Mueller, Bad Rappenau, both of (DE)

(73) Assignee: Robert Bosch GmbH, Stuttgart (DE)

( * ) Notice: Subject to any disclaimer, the term of this patent is extended or adjusted under 35 U.S.C. 154(b) by 24 days.

(21) Appl. No.: 09/759,250

(22) Filed: Jan. 16, 2001
Prior Publication Data
US 2001/0020465 A1 Sep. 13, 2001

(30) Foreign Application Priority Data

Jan. 14, 2000 (DE) ..... 100 01 274

(51) Int. Cl.[7] ..... F02P 5/15; G06G 7/76

(52) U.S. Cl. ..... 123/406.24; 123/406.29; 123/436; 701/111

(58) Field of Search ..... 123/406.12, 406.13, 123/406.14, 406.2, 406.21, 406.23, 406.24, 406.29, 436; 701/110, 111; 73/117.3, 116

(56) References Cited

U.S. PATENT DOCUMENTS 5,307,670 A * 5/1994 Imai et al. ..... 73/117.3
5,426,587 A * 6/1995 Imai et al. ..... 701/111
5,822,710 A * 10/1998 Mezger et al. ..... 123/436
5,862,505 A * 1/1999 Fujiki ..... 701/111
6,209,519 B1 * 4/2001 Melchior et al. ..... 123/406.24

FOREIGN PATENT DOCUMENTS

DE 4138765 7/1992
DE 10006004 C1 * 1/2000 ..... 123/406.24

* cited by examiner

*Primary Examiner*—Willis R. Wolfe
(74) *Attorney, Agent, or Firm*—Walter Ottesen

(57) ABSTRACT

The invention relates to a method for combustion misfire detection and cylinder equalization in a multi-cylinder internal combustion engine having knock control. In the method, rough-running values are individually determined for each cylinder by measuring segment times with each crankshaft rotation. The segment times include the times corresponding to the piston movement of each cylinder to be measured in which the crankshaft passes through a corresponding circular-segment angular region. Thereafter, the determined rough-running values are compared to a threshold value in a desired value comparison and, on the basis of the deviation between the determined rough-running values and the desired value, cylinder-individual equalization factors (that is, correction factors) are computed in an evaluation unit for the change of injection times or ignition time points of the individual cylinders. It is provided that the computed equalization factors ($GL_1$) for the change of injection times or the ignition time points or the charge serve as the basis for the determination of a rough-running increase value ($LUT_{corrected}$) effected by the change and that, with the determined rough-running increase value ($LUT_{corrected}$), a computation of a corrected rough-running value (dLUT) takes place. The corrected rough-running value (dLUT) is utilized for the computation of the final equalization factor ($GL_2$) for influencing injection times or ignition time points or the charge.

6 Claims, 1 Drawing Sheet

METHOD FOR DETECTING COMBUSTION MISFIRES AND CYLINDER EQUALIZATION IN INTERNAL COMBUSTION ENGINES WITH KNOCK CONTROL

BACKGROUND OF THE INVENTION

Methods for determining engine rough running by evaluating the engine rpm are used for spark-ignition engines as well as in diesel engines in order to detect a non-uniform running of the engine and to minimize this non-uniformity via suitable control arrangements. The non-uniform running of the engine can be caused, for example, by valve coking or, in direct injection engines, by scattering of the characteristic values of the injection valves.

Methods of this kind utilize the realization that a non-occurring or incomplete combustion within a cylinder of an engine is associated with characteristic changes of the torque trace of the engine compared to the normal operation.

SUMMARY OF THE INVENTION

From the comparison of the torque traces, one can distinguish between normal operation of the engine without misfires and so-called operation associated with misfires or non-optimal combustion. An incomplete or poor combustion of one or several cylinders contributes to a total torque trace of the engine with a reduced contribution. This contribution can be determined from a detection of the actual torques of the cylinders via an evaluation of the time-dependent trace of the crankshaft rotation or the camshaft rotation.

According to the method of the invention, a crankshaft angular region characterized as a segment is assigned to a specific region of the piston movement of each cylinder. The segments belonging to each cylinder are realized by markings on a transducer wheel coupled to the crankshaft. The segment time is the time in which the crankshaft passes through the corresponding angular region of the segment and is dependent essentially on the energy converted in the combustion stroke. Misfires or a poor combustion lead to an increase of the ignition synchronously detected segment times as a consequence of the deficient torque contribution. These segment times are determined for each cylinder by scanning the markings on the transducer wheel with a suitable sensor. The more uniform the engine runs, the smaller will be the differences between the segment times of the individual cylinders.

In accordance with methods already known from the state of the art, such as disclosed in German patent publication 4,138,765 (corresponding to U.S. patent application Ser. No. 07/818,884, filed Jan. 10, 1992, now abandoned), an index for the rough running of the engine is computed from differences of the segment times. Additional conditions such as the increase of the engine rpm for a vehicle acceleration are compensated by computation. The rough-running value, which is computed for each ignition, is compared in a subsequent method step in synchronism with the ignition in a desired value comparison to a threshold value. If the determined rough-running value exceeds the threshold value, which is dependent upon operating parameters such as load and rpm, then this is evaluated, for example, as a misfire of the particular cylinder.

In a further method step, equalization or correction factors are formed for individual cylinders in an evaluation unit and, with the aid of these factors, injection times, ignition time point times, or the charge of the individual cylinders, which are affected by the torque changes, can be influenced. For example, a change of the ignition time point can change the torque component of a cylinder. Furthermore, by influencing injection times and injection duration, the differences in the injection performance of injection valves can be compensated. Furthermore, for a system with cylinder-individual adjustment of the cylinder charge (for example, via individual throttle flaps or fully variable inlet and/or outlet valves), the cylinder individual charge can be adapted.

The above-described method, which is known from the state of the art, has been proven in the context of engine management systems for bringing about a cylinder equalization. The cylinder-individual interventions undertaken here can, however, lead to the situation that a knocking combustion in one or several cylinders, which occurs under specific conditions, is additionally amplified. For this reason, in known engine management systems, which have a knock control in addition to the cylinder equalization, a use of both systems at the same time is precluded. This can be attributed to the situation that the changes of the ignition angle, which are undertaken because of the knock control, can lead to a change of the rough-running value. These changes of the ignition angle are caused, for example, by an ignition angle retardation. Should the cylinder equalization by means of injection time correction be active in this case simultaneously with the knock control, then the cylinder equalization for reducing the rough-running values would effect an enrichment of the gas mixture because of changed injection times in the cylinder subjected to knocking combustion.

However, an enrichment of the above kind perforce leads to a further increase of the knocking combustion within the cylinder during the combustion so that neither the objective of a quiet engine running nor the elimination of the knocking combustion can be achieved by the cylinder equalization and the knock control of the engine management system.

From the state of the art, possibilities are known for acting on the operating state of internal combustion engines. In contrast thereto, the method of the invention affords the advantage that, for the first time, a knock control and a cylinder equalization can be combined without the concern that there will be a larger misidentification in the detection of misfires in the context of the cylinder equalization and, on the other hand, without the knock tendency of the particular engine being increased because of the measures of cylinder equalization. This takes place in accordance with the invention in that the equalization factors (that is, correction factors) for the change of the injection times or the ignition time points serve as the basis for the determination of a rough-running increase value effected by the change and in that, with the determined rough-running increase value, a computation of a corrected rough-running value takes place. The above-mentioned equalization factors and/or correction factors are computed in the context of the rough-running computation for the cylinder equalization. The corrected rough-running value is used for the computation of the final equalization factor and/or correction factor for influencing the injection times or the ignition time points.

Because of the fact that the rough-running value, which is decisive for the final computation of the equalization factors and/or correction factors, is subjected to a correction step in advance of the computation, the rough-running value increase, which takes place normally without correction, is eliminated so that an unwanted interaction between knock control and cylinder equalization is avoided.

The rough-running increase value, which is to be determined, can, according to the invention, be determined in different ways. Thus, it is conceivable to determine this value from the computed equalization factor and/or correction factor via a characteristic field computation. The relationship between the rough-running increase, which is to be determined, and an ignition angle shift, which is to be carried out, is stored in a characteristic line within the engine management system so that the rough-running increase can be determined in a simple manner. Furthermore, the possibility is present to determine the rough-running increase value from the torque as a function of the ignition angle efficiency. This affords the advantage that the relationship between torque and ignition angle efficiency is already stored in the engine system as a function. Furthermore, it is conceivable to determine the rough-running increase value as a function of the injection time span in the expansion phase of the particular cylinder (so-called double injection). This applies also for the individual charge of a cylinder. Here too, the charge difference to the other cylinders can be considered via the rough-running increase value.

BRIEF DESCRIPTION OF THE DRAWING

The invention will now be described with reference to the single FIGURE (FIG. 1) of the drawing which shows the sequence of steps of the method of the invention in the context of a block diagram.

DESCRIPTION OF THE PREFERRED EMBODIMENTS OF THE INVENTION

Figure 1:
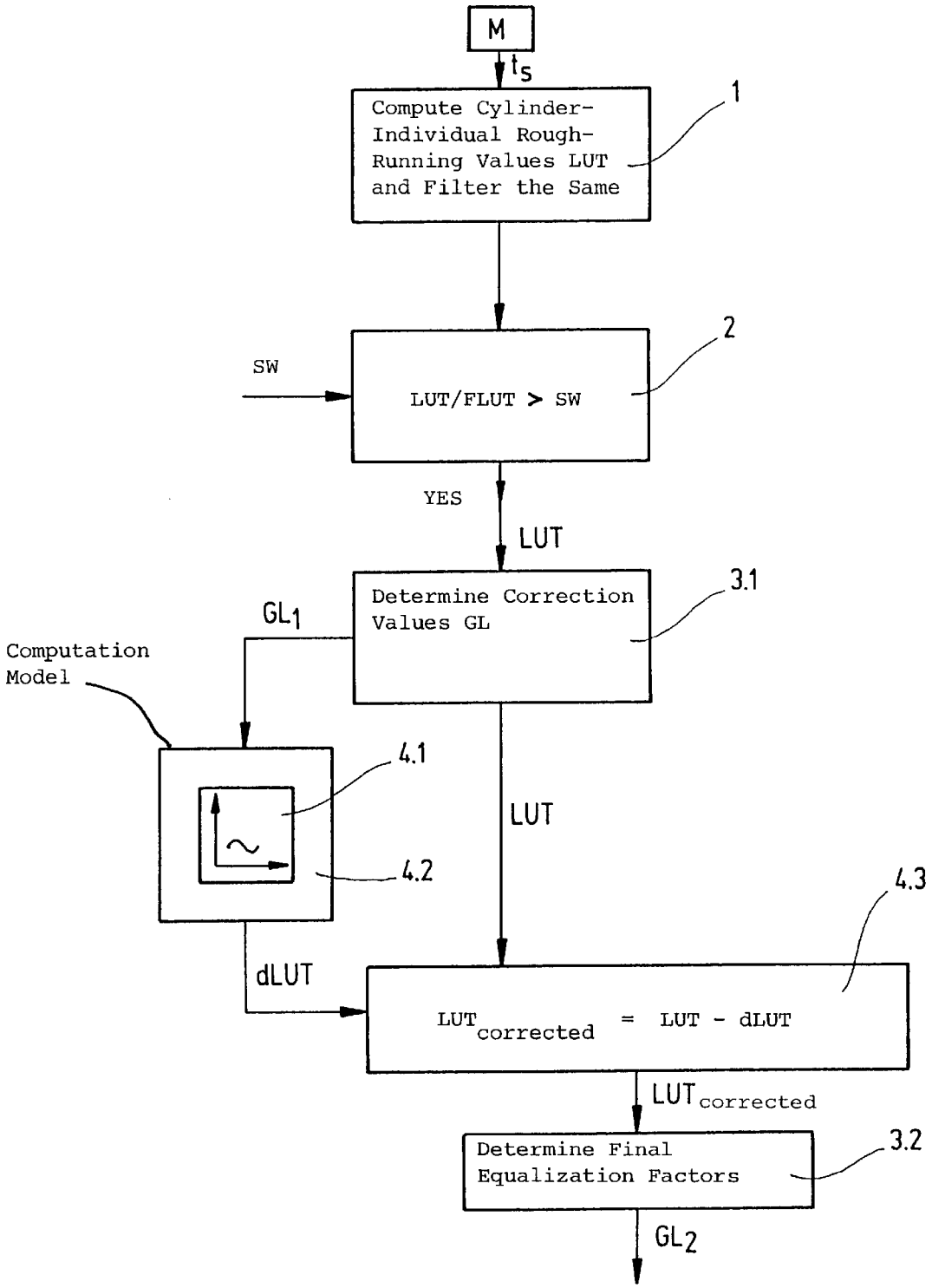

FIG. 1 shows a method for a cylinder of a multi-cylinder internal combustion engine by way of example. The sequence of the method steps for the corresponding remaining cylinders takes place in correspondence to the illustrated block diagram in the components of the engine management system which are provided for the method.

In FIG. 1, the internal combustion engine M is shown as a block. A cylinder-individual segment time $t_s$ is determined in the engine M by means of a transducer wheel on which the individual segments are provided. The transducer wheel is connected to the crankshaft or to the camshaft. This segment time $t_s$ can be extended compared to the normal engine operation in the event that an incomplete combustion or a combustion misfire takes place in the corresponding cylinder. The segment time $t_s$, which is determined via suitable sensors by means of the transducer wheel, is next supplied to a computation block 1 which computes cylinder-individual rough-running values LUT from the segment times $t_s$. The block 1 includes a filter element wherein the determined rough-running values LUT are subjected to filtering. The values LUT filtered in this manner are identified as FLUT. The LUT/FLUT-values are next subjected to a desired value comparison with a threshold value SW in a comparison block 2. If the desired value comparison yields that the cylinder-individual rough-running values LUT/FLUT are greater than the threshold value SW, then the amount of the LUT value is transmitted further to a PI-controller 3.1. The LUT value is a direct index for the control deviation from the normal state within the particular cylinder which is intended to be eliminated in the context of the cylinder equalization. The PI-controller 3.1 determines equalization values or correction values GL from the control deviation for the particular cylinder. These values GL are decisive for an adaptation of the injection time and/or of the ignition time point and/or of the charge of the particular cylinder in order to effect a return into the normal state. To this extent, the method steps explained above are from methods for cylinder equalization known from the state of the art. As output quantities of the PI-controller 3.1, the rough-running value LUT as well as the equalization factor $GL_1$ are shown in FIG. 1. The computed equalization factor $GL_1$ is supplied to a computation module in the next method step. This computation model determines a rough-running increase value dLUT in dependence upon the input quantity $GL_1$. This can take place, for example, via a characteristic field contained in the computation module wherein the relationship is stored between an ignition angle shift, which is to be undertaken, and/or an injection time correction and/or the charge correction or charge change of the rough-running increase, which results therefrom.

The characteristic field values can, however, also be determined via application. Furthermore, it is conceivable to determine the rough-running increase value, for example, from the torque as a function of the ignition angle efficiency or as a function of the injection time or as a function of cylinder-individual charge differences or as a function of the injection time span in the expansion phase (with a double injection) of the particular cylinder. The decision, in which way the rough-running increase value is computed, results from the other conditions of the engine management system. The output quantity of the computation block 4.2, the rough-running increase value dLUT, serves subsequently as the input quantity of the block 4.3 wherein a corrected rough-running value $LUT_{corrected}$ is determined. This rough-running value $LUT_{corrected}$ is determined from the original uncorrected rough-running value LUT while considering the rough-running increase value via subtraction. This corrected rough-running value is subsequently supplied to a computation block 3.2 wherein the final equalization factors for the individual cylinders are determined analog to the computation block 3.1. The final equalization factors are needed for the cylinder equalization.

Because of the fact that the rough-running value is subjected to a correction method, it is precluded that the function of a knock control is negatively affected.

Furthermore, by applying the corrected rough-running values, the recognition quality of a misfire identification is improved which takes place usually by means of a comparison of the rough-running value with a threshold value.

It is understood that the foregoing description is that of the preferred embodiments of the invention and that various changes and modifications may be made thereto without departing from the spirit and scope of the invention as defined in the appended claims.

What is claimed is:

1. A method for detecting combustion misfires and cylinder equalization in a multi-cylinder internal combustion engine having knock control, the method comprising the following steps for each crankshaft revolution:

individually determining rough running values for each cylinder of said engine by measuring segment times which include times corresponding to the piston movement of each cylinder to be measured in which the crankshaft passes through a corresponding circular segment angular region;

comparing the determined rough-running values to a threshold value in a desired value comparison;

computing correction factors for each cylinder for the change of injection times or ignition time points or charge of the individual cylinders in an evaluation unit on the basis of the deviation between the determined rough-running values and desired value;

permitting the computed correction factors ($GL_1$) to serve as the basis for the determination of a rough-running increase value (dLUT) effected by said change;

computing a corrected rough-running value ($LUT_{corrected}$) with the determined rough-running increase value (dLUT); and, utilizing the corrected rough-running value ($LUT_{corrected}$) for the computation of final correction factors ($GL_2$) for operating on the injection times or ignition time points.

2. The method of claim 1, wherein said rough-running increase value ($LUT_{corrected}$) is determined from the correction factors ($GL_1$) via a characteristic field computation.

3. The method of claim 1, wherein said rough-running increase value ($LUT_{corrected}$) is determined from the correction factor for an ignition angle shift.

4. The method of claim 1, wherein said rough-running increase value ($LUT_{corrected}$) is determined from the torque as a function of the ignition angle efficiency.

5. The method of claim 1, wherein said rough-running increase value ($LUT_{corrected}$) is determined from the torque as a function of the injection time span in the expansion phase of the particular cylinder.

6. The method of claim 1, wherein said rough-running increase value ($LUT_{corrected}$) is determined from the rough-running value as a function of the injection time span in the expansion phase of the particular cylinder.

* * * * *